US012196079B2

(12) United States Patent
Arian et al.

(10) Patent No.: US 12,196,079 B2
(45) Date of Patent: Jan. 14, 2025

(54) DOWNHOLE TESTING TOOL FOR SUBTERRANEAN FORMATION TESTING USING A FLUID SAMPLING PROBE ASSEMBLY

(71) Applicant: Halliburton Energy Services, Inc., Houston, TX (US)

(72) Inventors: Abbas Arian, Houston, TX (US); Bruce Mackay, Houston, TX (US); Darren George Gascooke, Houston, TX (US); Matthew L. Lee, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/305,906

(22) Filed: Apr. 24, 2023

(65) Prior Publication Data

US 2024/0352856 A1 Oct. 24, 2024

(51) Int. Cl.
*E21B 49/10* (2006.01)

(52) U.S. Cl.
CPC ..... *E21B 49/10* (2013.01)

(58) Field of Classification Search
CPC ..... E21B 43/10
See application file for complete search history.

(56) References Cited

U.S. PATENT DOCUMENTS 3,217,804 A * 11/1965 Peter ..... E21B 49/10 73/152.01
3,338,307 A * 8/1967 Redwine ..... E21B 49/10 166/264
4,210,018 A 7/1980 Brieger
5,549,159 A 8/1996 Shwe et al.
5,741,962 A * 4/1998 Birchak ..... G01V 1/40 73/152.16
6,658,930 B2 12/2003 Abbas
(Continued)

FOREIGN PATENT DOCUMENTS

GB 2441843 A * 3/2008 ..... E21B 33/1246
WO 2005072430 A2 8/2005

OTHER PUBLICATIONS

Cambridge Dictionary, "hydraulic fluid", Aug. 26, 2024, https://dictionary.cambridge.org/us/dictionary/english/hydraulic-fluid, 6 pages (Year: 2024).*

*Primary Examiner* — Jennifer H Gay
(74) *Attorney, Agent, or Firm* — John Wustenberg; Parker Justiss, P.C.

(57) ABSTRACT

Formation testing apparatus including a downhole testing tool for subterranean formation testing within a borehole of a well, the tool including a downhole sampling device having: a test tool body having an outer surface; and assembly extendable out of and retractable into an opening in the outer surface. The assembly includes a seal pad at a first end of the formation probe sampling assembly, the seal pad operable to contact a formation wall of the borehole when the seal pad is extended past the outer surface to thereby define a seal space between the borehole and the seal pad. The seal pad includes at the first end includes a metal plate with a trough therein, the trough defining a closed track in the metal plate, the trough having dimensions to hold a portion of an inflatable elastomeric ring shaped to fit in the trough. Methods of assembly and testing are disclosed.

20 Claims, 13 Drawing Sheets

(56) References Cited

U.S. PATENT DOCUMENTS 7,128,144 B2 * 10/2006 Fox ..... E21B 49/10 166/264
7,584,655 B2 * 9/2009 van Zuilekom ..... E21B 49/10 166/100
7,654,321 B2 * 2/2010 Zazovsky ..... E21B 49/10 166/264
7,690,423 B2 * 4/2010 Del Campo ..... E21B 49/10 166/100
8,015,867 B2 * 9/2011 Kerr ..... E21B 49/10 166/100
8,162,052 B2 * 4/2012 Goodwin ..... E21B 33/127 166/264
8,220,536 B2 * 7/2012 Tao ..... E21B 33/1216 166/264
8,439,110 B2 * 5/2013 Corre ..... E21B 49/08 166/57
8,561,686 B2 * 10/2013 Tao ..... E21B 33/1216 166/264
8,584,748 B2 * 11/2013 Church ..... E21B 49/10 166/264
9,022,105 B2 * 5/2015 Corre ..... E21B 49/10 166/227
9,284,837 B2 * 3/2016 Proett ..... E21B 49/10
10,227,970 B2 * 3/2019 Gisolf ..... F04B 49/22
10,358,917 B2 * 7/2019 Cig ..... E21B 49/00
2003/0098156 A1 5/2003 Follini et al.
2004/0173351 A1 * 9/2004 Fox ..... E21B 49/10 166/264
2007/0151727 A1 * 7/2007 Tao ..... E21B 33/1216 166/250.1
2008/0156487 A1 * 7/2008 Zazovsky ..... E21B 49/10 166/264
2008/0295588 A1 * 12/2008 van Zuilekom ..... E21B 49/088 73/152.26
2009/0211756 A1 * 8/2009 Goodwin ..... E21B 36/006 166/57
2010/0083748 A1 * 4/2010 Kerr ..... E21B 49/10 73/152.26
2010/0132940 A1 * 6/2010 Proett ..... E21B 49/10 166/250.17
2010/0155053 A1 * 6/2010 Tao ..... E21B 49/10 166/119
2011/0162836 A1 * 7/2011 Church ..... E21B 49/10 166/264
2011/0277999 A1 * 11/2011 Corre ..... E21B 33/127 166/57
2011/0284212 A1 * 11/2011 Tao ..... E21B 33/1216 166/119
2014/0151039 A1 * 6/2014 Corre ..... E21B 33/1277 166/185
2014/0157883 A1 * 6/2014 Tao ..... E21B 49/10 166/100
2015/0369957 A1 * 12/2015 Cig ..... E21B 49/08 702/12
2016/0177714 A1 * 6/2016 Tao ..... F04B 47/04 166/66
2017/0363077 A1 * 12/2017 Gisolf ..... F04B 47/02
2018/0340420 A1 * 11/2018 Milh ..... E21B 49/10
2022/0178251 A1 * 6/2022 De Gennaro ..... E21B 49/006

* cited by examiner

DOWNHOLE TESTING TOOL FOR SUBTERRANEAN FORMATION TESTING USING A FLUID SAMPLING PROBE ASSEMBLY

TECHNICAL FIELD

This application is directed, in general, to a formation testing apparatus including a down hole testing tool for testing subterranean formations and, more specifically, to obtaining formation samples using a formation sampling probe assembly and methods of assembling and use for formation sampling.

BACKGROUND

Existing pressure and fluid sampling probes are typically designed with a solid elastomer ring that is molded onto a metal plate. Bounded by the solid elastomer ring, is an open surface area for the formation fluid to flow into a downhole pressure and fluid sampling tool. The probe is installed on a piston that is hydraulically or mechanically driven into the borehole wall with high force. The solid elastomer ring creates a seal between the borehole and the open surface area bounded by the elastomer ring. Once there is a seal the formation fluid can be drawn into the downhole pressure and fluid sampling tool to obtain true formation pressure and/or fluid samples. In certain cases it can be difficult for the sampling probe to get a good seal on the borehole wall because of borehole wall non-uniformities, such as ovality, washouts, or voids in the formation matrix.

BRIEF DESCRIPTION

Reference is now made to the following descriptions taken in conjunction with the accompanying drawings, in which:

FIG. 1 presents a schematic view of an embodiment of a system including a formation testing apparatus disposed in a subterranean well and illustrates an example system for drilling operations;

FIG. 2 presents a schematic view of a portion of an embodiment of the downhole testing tool disposed in a well and including a downhole sampling device of the disclosure;

FIG. 3 presents a perspective view of a portion an embodiment of the formation sampling probe assembly of the downhole sampling device with the assembly in an extended position relative to a test tool body of the device;

FIG. 4A presents a sectional view of an embodiment of the formation probe sampling assembly and the test tool body, corresponding to view line 4A-4A in FIG. 3;

FIG. 4B presents an exploded sectional view of an embodiment of the formation probe sampling assembly analogous to the assembly shown in FIG. 4A;

FIG. 4C presents an exploded perspective view of an embodiment of the formation probe sampling assembly analogous to the assembly shown in FIG. 4B;

Figure 7:
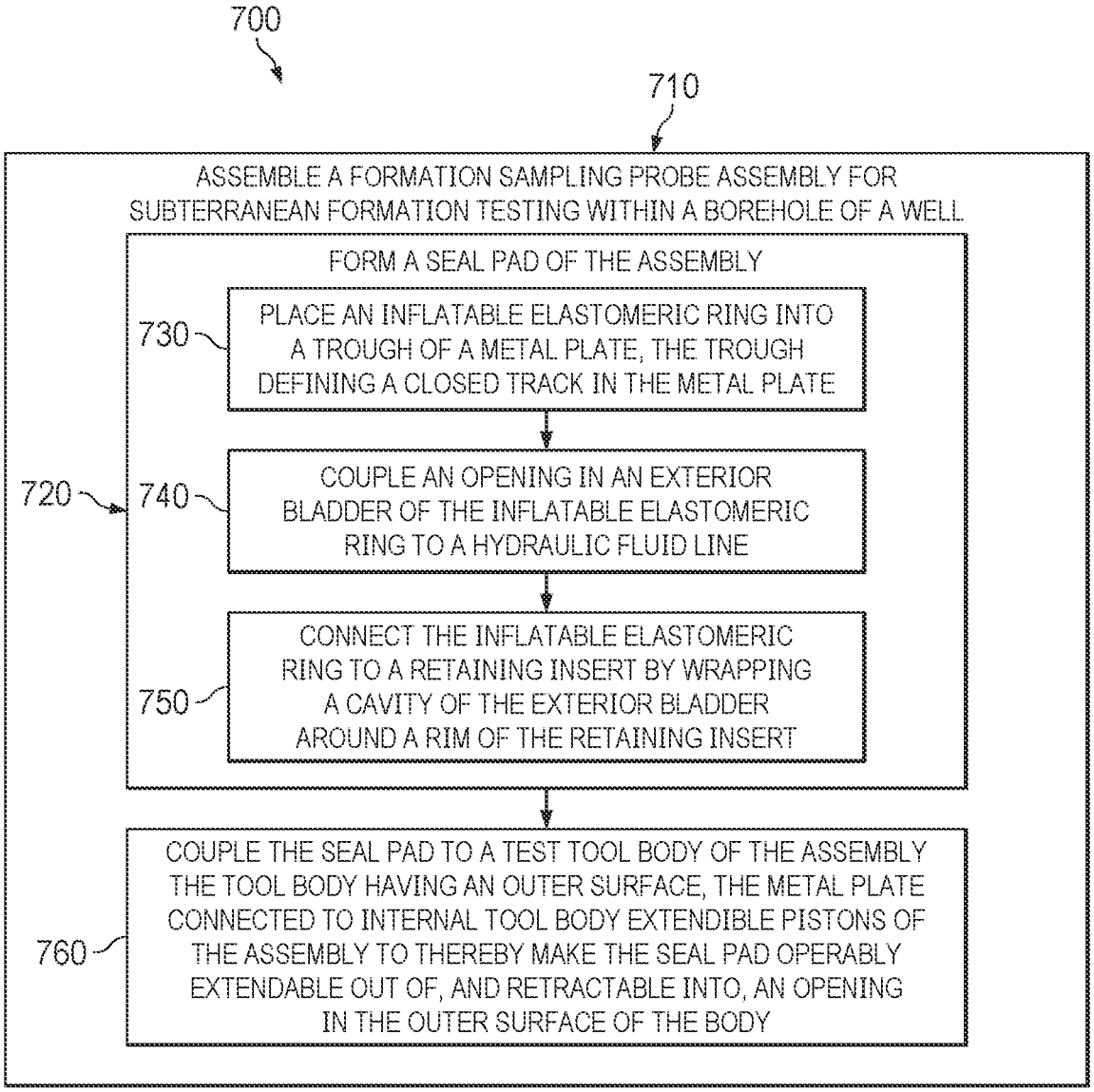
Figure 8:
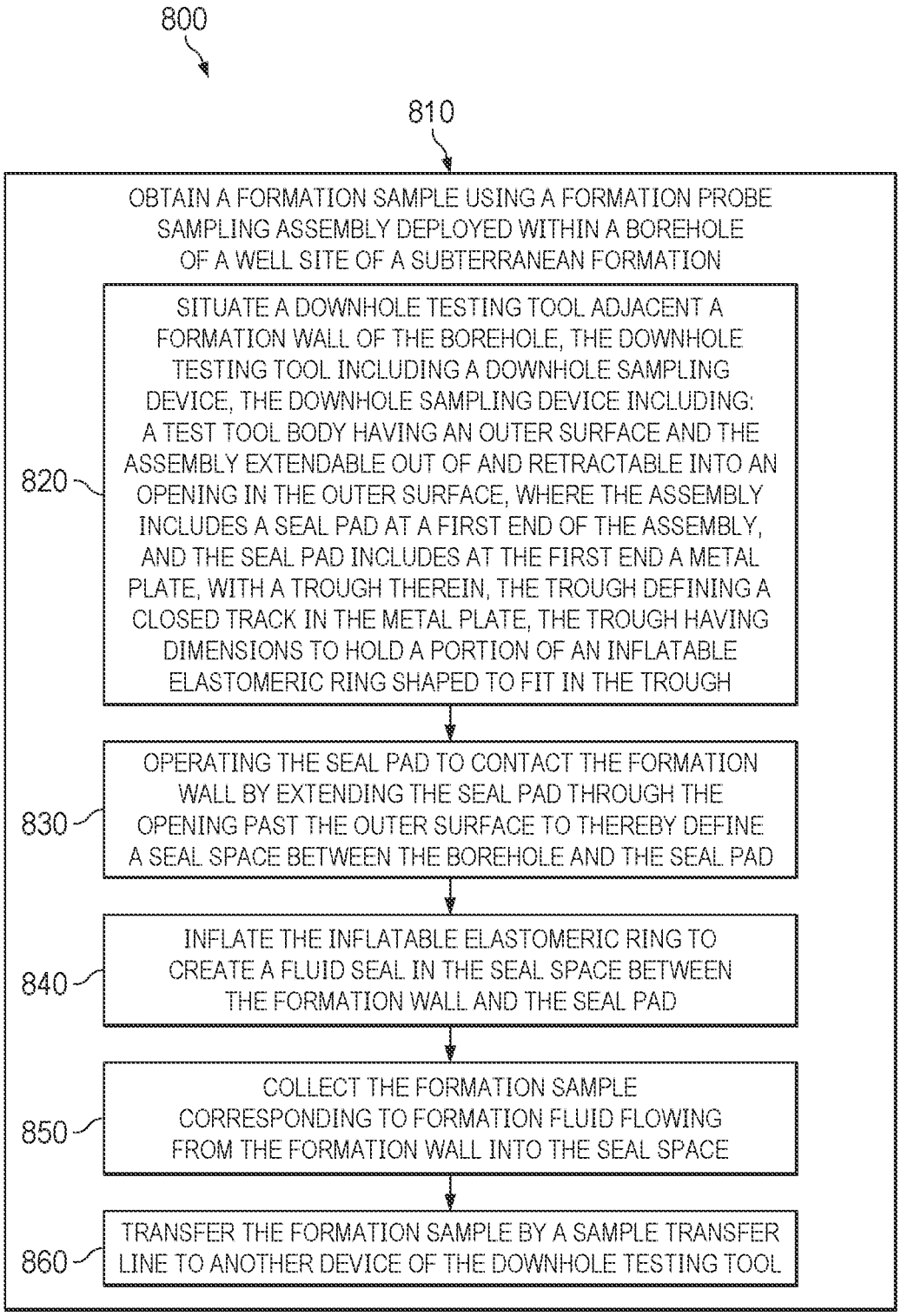

FIG. 7 presents a flow diagram of an example method of assembling a formation sampling probe for subterranean formation testing within a borehole of a well site in accordance with the present disclosure; and FIG. 8 presents a flow diagram of an example method of obtaining a sample using a formation sampling probe deployed in within a borehole of a well site of a subterranean formation in accordance with the present disclosure.

DETAILED DESCRIPTION

Disclosed herein is a downhole sampling device that, in some embodiments, can swivel to adapt to borehole ovality and have an inflatable elastomeric ring. The ring is inflatable to help create a seal with a formation wall if there are washouts, voids or other non-uniformities in the formation wall. Creating a seal by inflating the ring can be advantageous as compared to using a solid non-inflatable ring in that less force needs to be applied to create the seal and therefore the seal is more readily achieved for a broader range of non-uniform formation wall surfaces.

Because some embodiments of the probe can swivel and inflate there is a novel design to route the inflate and sampling probe lines from the downhole pressure and fluid sampling tool to the probe itself and allow for movement of the probe out and in from the downhole tool body.

Some embodiments of the inflatable elastomer element ring are designed to be easily changed on the metal plate unlike typical probes where the metal is molded onto the metal plate. Some embodiments of the probe are further designed to both swivel and inflate to facilitate forming a seal with non-uniform formation walls.

Figure 1:
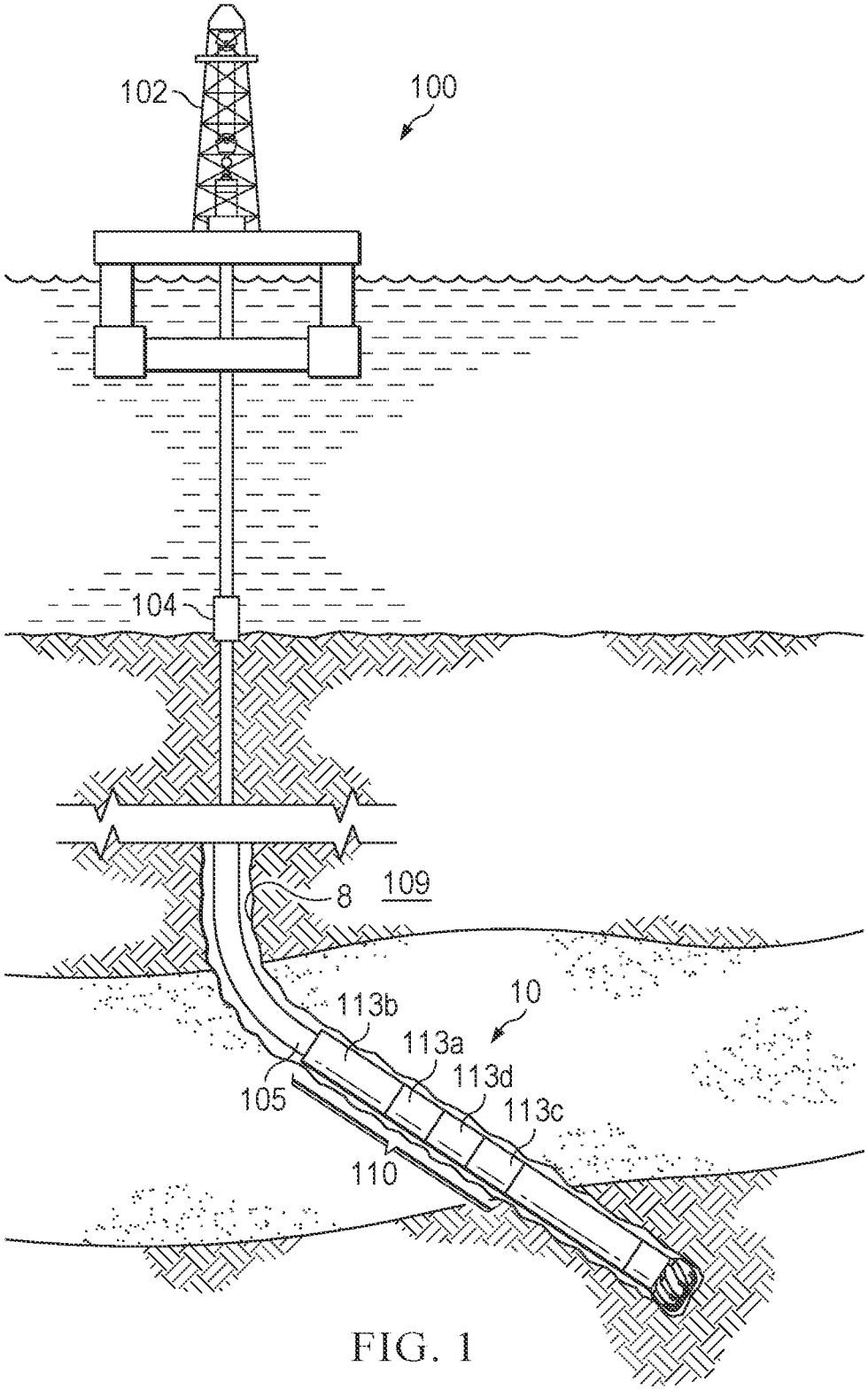

One embodiment of the disclosure is a formation testing apparatus. FIG. 1 presents a schematic view of an embodiment of a system 100 including a formation testing apparatus 10 disposed in a subterranean well. FIG. 1 further illustrates an example system 100 for drilling operations. The apparatus 10 includes a downhole testing tool 110 for subterranean formation testing within a borehole 8 of a well The downhole testing tool 110 include a downhole sampling device 113*a* as further disclosed herein.

The system 100 includes a drilling rig 102 located at a surface 104 of a well. The drilling rig 102 provides support for a drill string 105. The drill string 105 penetrates a rotary table for drilling a borehole 8 through subsurface formations 109. A downhole testing tool 110 of the apparatus 10 may include any of a number of different types of device tools including measurement-while-drilling (MWD) tools, logging-while-drilling (LWD) tools, wireline tools etc.

For example, the downhole testing tool 110 can include, in various embodiments, one or more of different downhole device sensors (e.g., sensor 113*b*), which monitor different downhole parameters and generate data that is stored within one or more different storage mediums 113*d* within the downhole tool. The downhole tool 110 can include a power source (e.g., power source 113*c*). Such as a battery or generator. A generator could be powered either hydraulically or by the rotary power of the drill string. The generator could also be on the surface and the power supplied through conductor or conductors in a wireline or drill pipe. Components of the downhole testing tool (e.g., downhole sampling device 113*a*, sensor 113*b*) can be powered by the power source 113*c*.

In some embodiments, the formation testing apparatus 10 may be mounted on a drill collar or wireline deployed. Thus, even though the formation testing apparatus 10 is shown as part of drill string 105, some embodiments of the invention described below may be conveyed down borehole 8 via any drill string or wireline technology, as familiar to those skilled in the art.

Figure 2:
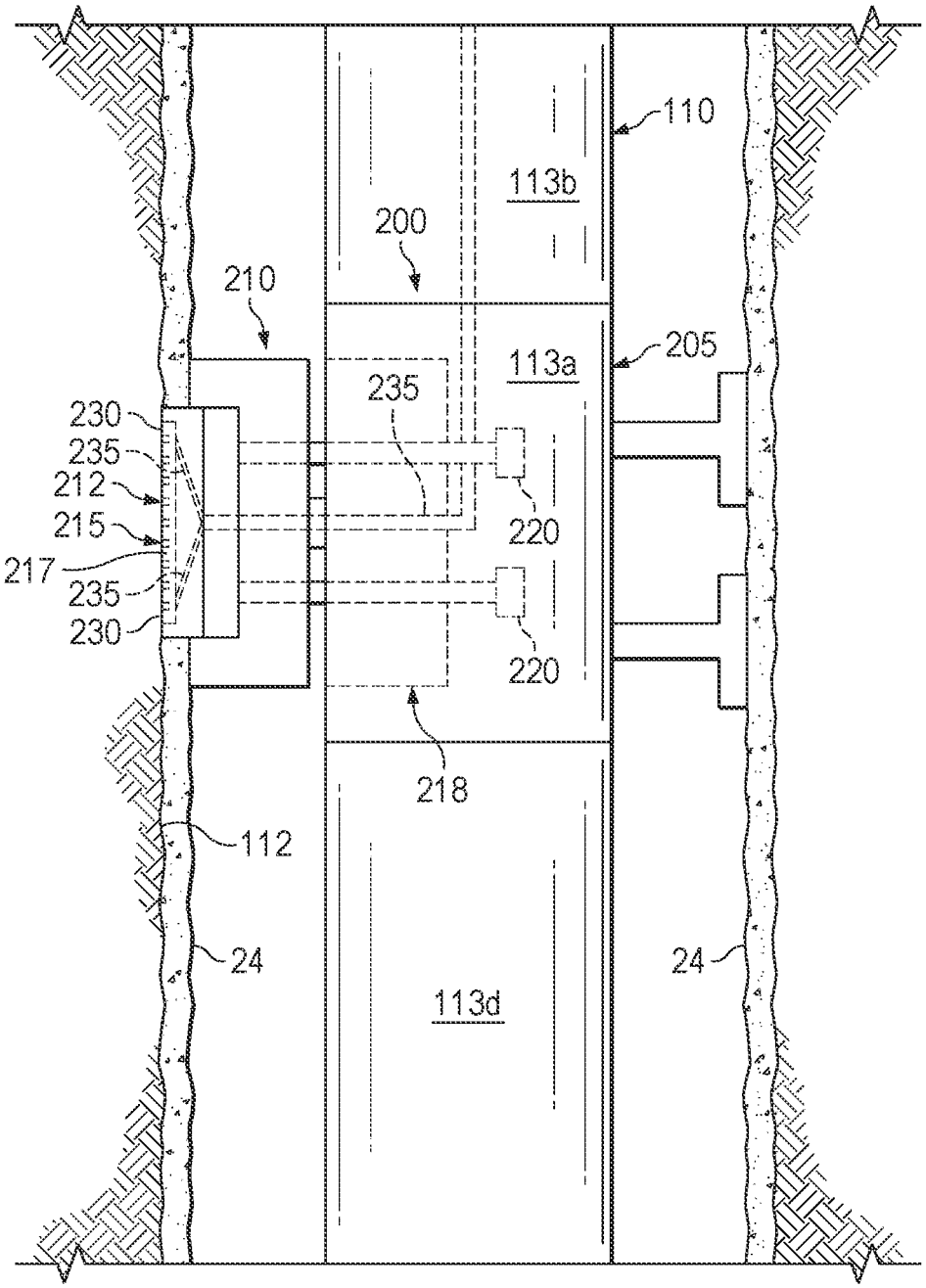

FIG. 2 presents a schematic view of a portion of an embodiment of the downhole testing tool 110 disposed in a well and including the downhole sampling device 113*a*. The downhole sampling device has a test tool body 200 having an outer surface 205 and a formation sampling probe assembly ('assembly') 210. The assembly 210 includes a seal pad 212 at a first end 215 of the assembly. The seal pad 212 is operable to contact a formation wall 112 of the borehole 8 when the seal pad is extended past the outer surface 205 and through a mud cake 24 to thereby define a seal space 217 between the borehole 8 and the seal pad (e.g., the portion of the wall 112 covered by the seal pad). The seal pad is operably extendable out of, and retractable into, an opening 218 in the outer surface 205 of the body 200. As depicted in FIG. 2, the assembly 210 is shown in an extended position. Extension can be facilitated by internal tool body extendible pistons 220 of the downhole sampling device 113*a*. As illustrated, the downhole testing tool 110 can further include one or more external extendible backup pistons 130, e.g., to help centrally stabilize the tool 110 in the borehole.

Figure 3:
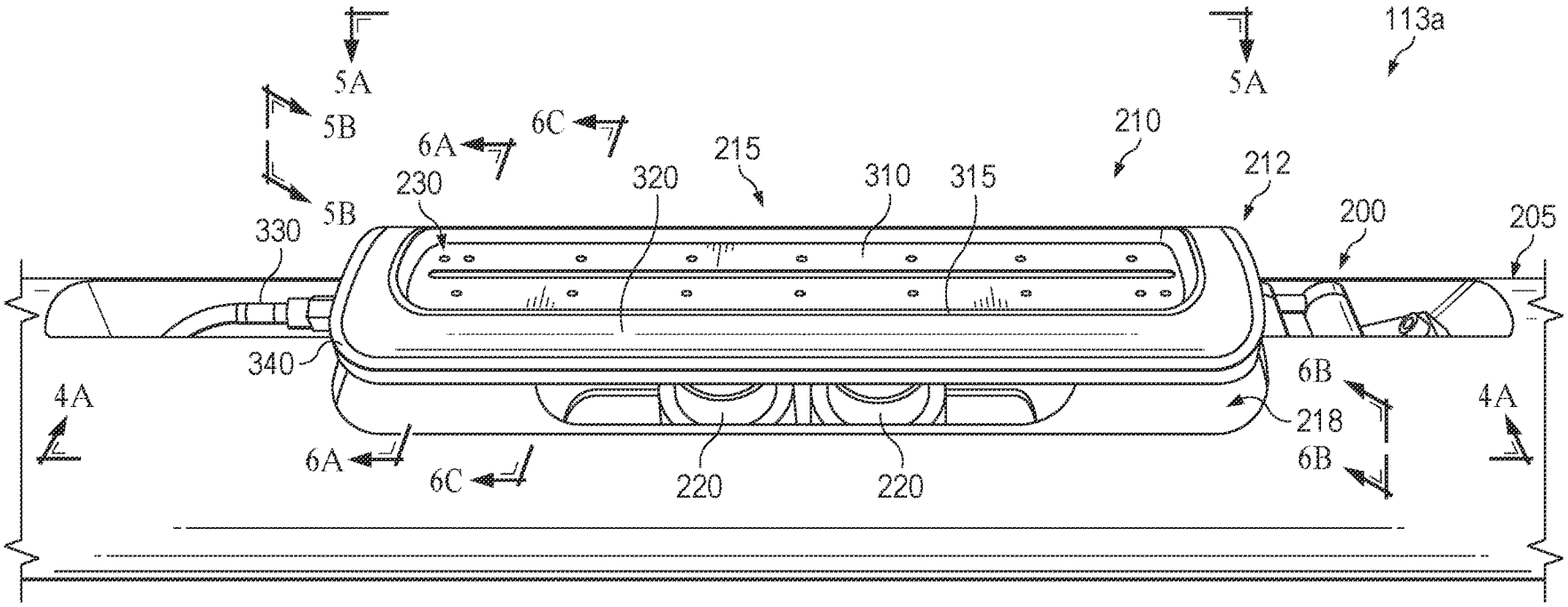
Figure 4A:
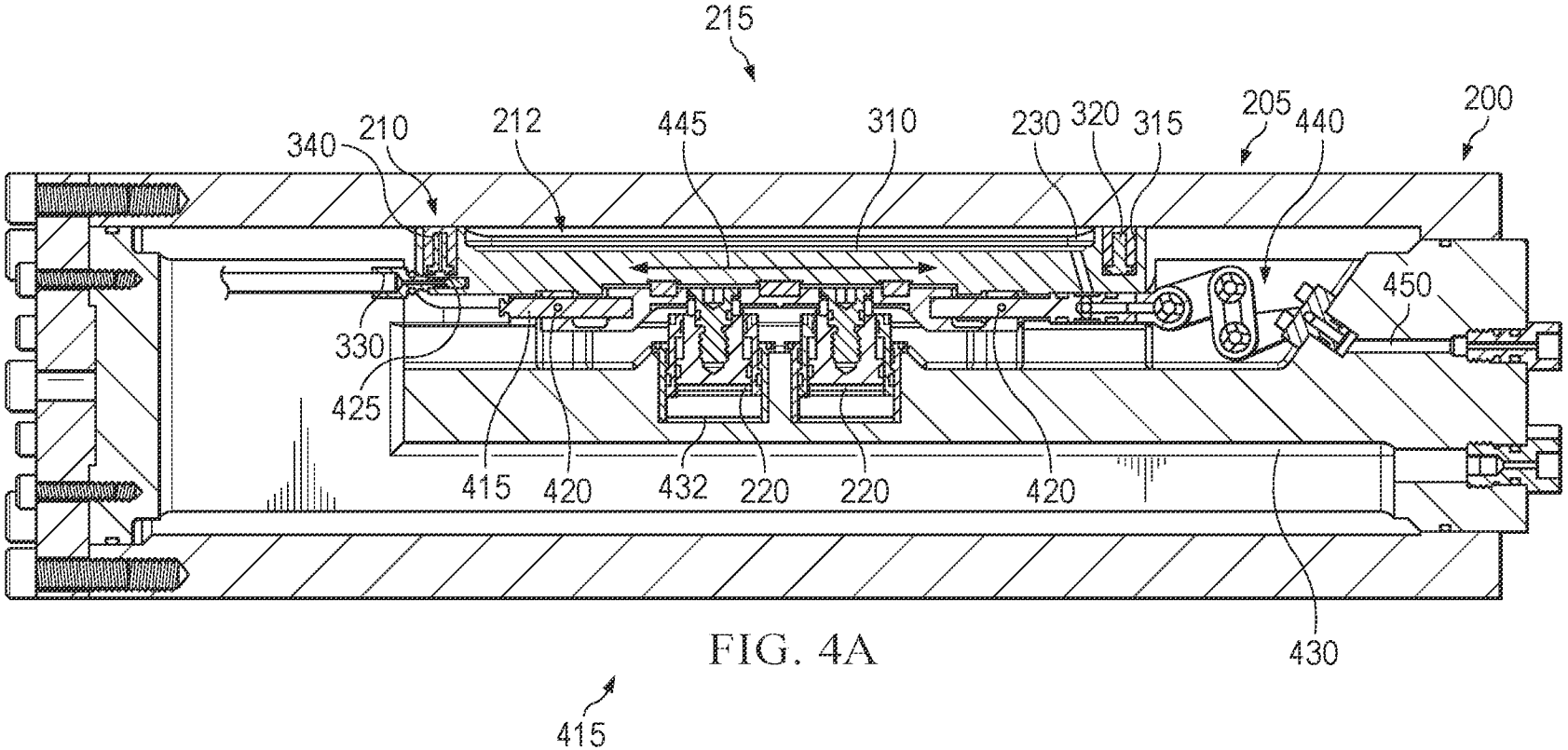
Figure 4B:
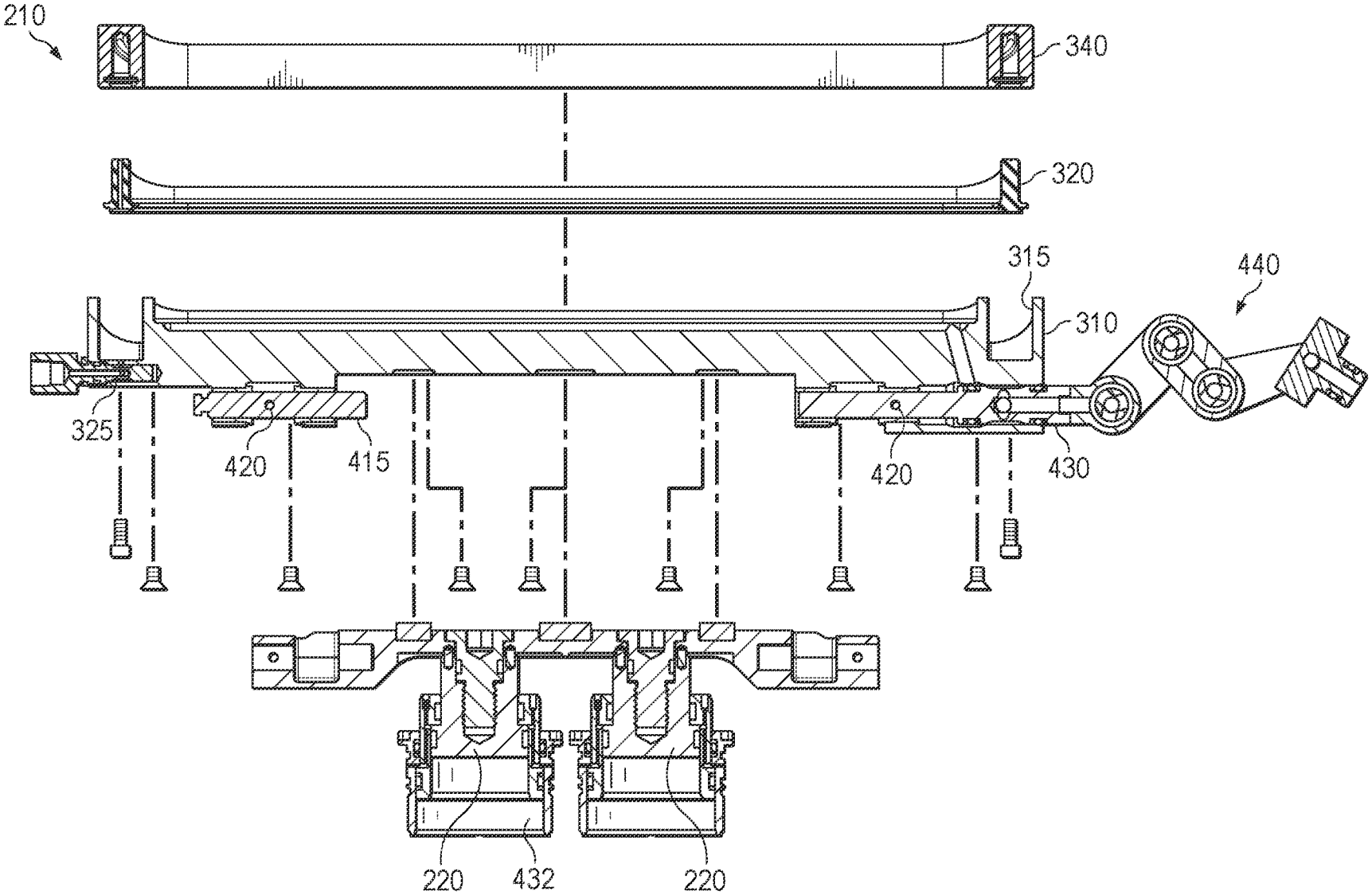
Figure 4C:
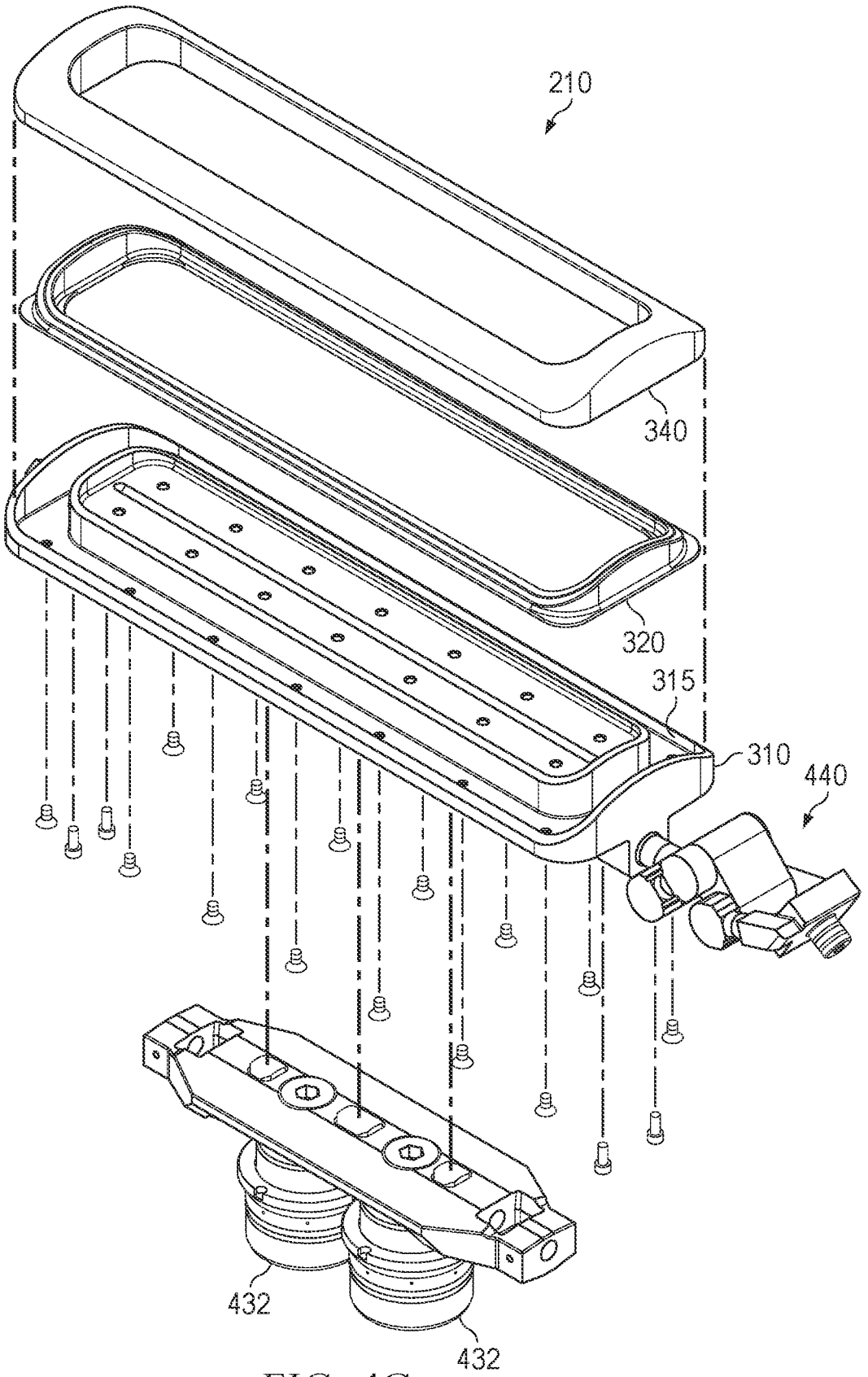
Figure 5A:
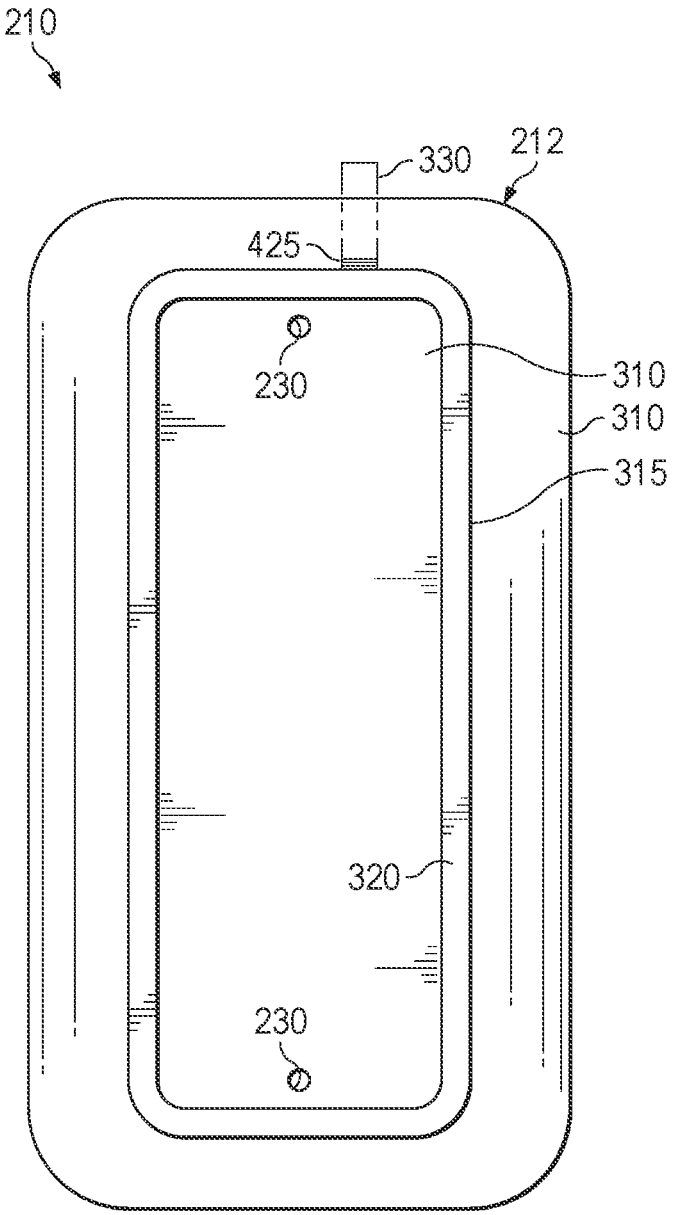
FIG. 5A shows a plan view of an embodiment of the formation probe sampling assembly of the disclosure along view line 5A shown in FIG. 3.
Figure 5B:
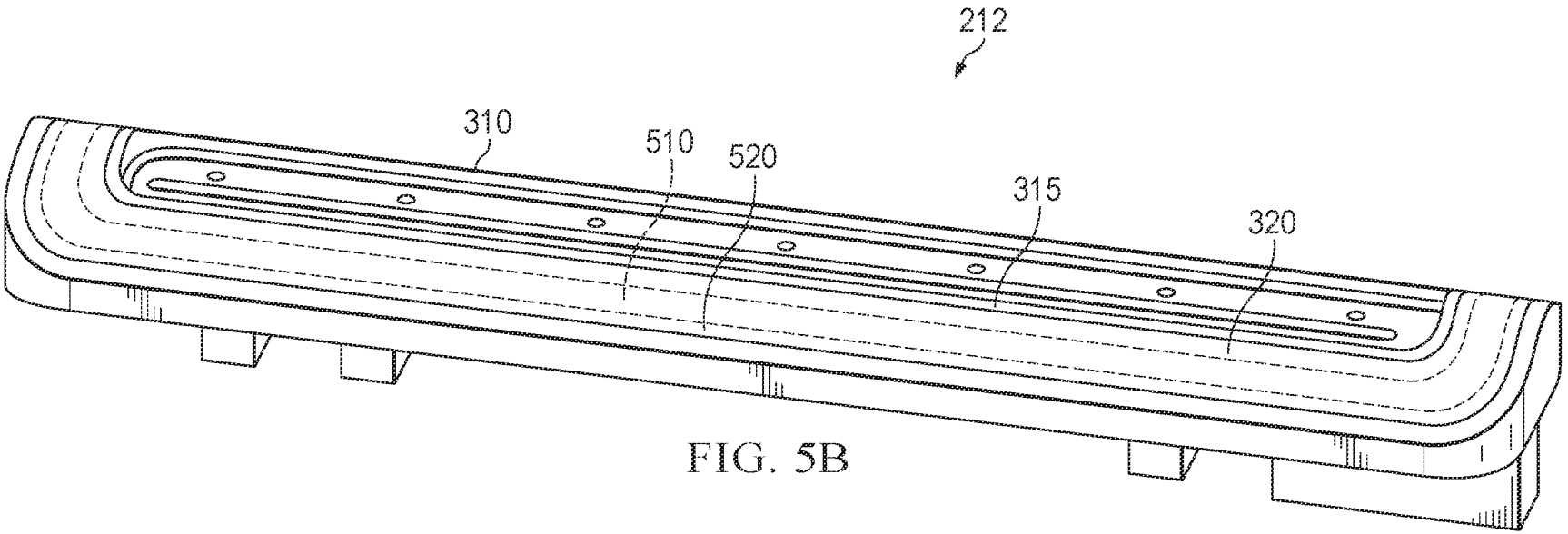
FIG. 5B shows a perspective view of a portion of an embodiment of the formation probe sampling assembly of the disclosure along view line 5B shown in FIG. 3.

FIG. 3 presents a perspective view of a portion an embodiment of the assembly 210 of the downhole sampling device 113*a* with the assembly 210 in an extended position relative to a test tool body 200 of the device. FIG. 4A presents a sectional view of an embodiment of the assembly 210 and the test tool body 200, corresponding to view line 4A-4A in FIG. 3, FIG. 4B presents an exploded sectional view of an embodiment of the assembly 210 analogous to that shown in FIG. 4A and FIG. 4C presents an exploded perspective view of an embodiment of the assembly 210 analogous that shown in FIG. 4B. FIG. 5A shows a plan view of an embodiment of the assembly 210 along view line 5A shown in FIG. 3. FIG. 5B shows a perspective view of a portion of an embodiment of the assembly 210 along view line 5B shown in FIG. 3.

With continuing reference to FIGS. 3-5B throughout, the seal pad 212 at the first end 215 of the assembly 210 includes a metal plate 310 with a trough 315 therein. The trough defines a closed track (e.g., a circular, oval or other closed racetrack shape) in the metal plate. The trough 315 has dimensions (e.g., width and depth) to hold a portion of an inflatable elastomeric ring 320 shaped to fit in the trough 315. In some embodiments, e.g., to help protect the ring from damage during deployment of the apparatus 10 in the borehole 8, when the inflatable elastomeric ring 320 is deflated, substantially the entire volume of the ring (e.g., 80, 90, 95, or 100% in various embodiments) can be held within the trough.

Embodiments of the formation testing apparatus 10 can include the inflatable elastomeric ring 320, and, in some such embodiments, the ring 320 includes a hollow interior 510 and an exterior bladder 520. The exterior bladder including an opening 425 coupleable to a hydraulic fluid line 330 of the downhole testing tool 110. Inflation of the inflatable elastomeric ring creates a fluid seal between the borehole and the inflatable elastomeric ring 320 of the seal pad. The term fluid seal as used herein means that the portion of the wall contacted by the inflatable ring, when in its inflated state, seals out mud and other fluids flowing in the bore from the defined seal space 217, and, formation fluid flowing into the seal space is sealed out of the borehole.

In some such embodiments, a total external inflated volume of the inflatable elastomeric ring 320 is expandable by at least 10, 20, 30, or 40% when a hydraulic fluid is flowed into the hollow interior to a pressure of about 50, 100, 150 or 200 psi, respectively, as compared to a total external deflated volume of the inflatable elastomeric ring when the hollow interior is at ambient pressure (e.g., atmospheric pressure) when the inflatable elastomeric ring is deflated.

In some such embodiments, the exterior bladder 520 can be composed of silicon rubber, a fluoroelastomeric rubber, a copolymer rubber, or other elastomeric rubber materials familiar to those skilled in the pertinent arts.

Figure 6A:
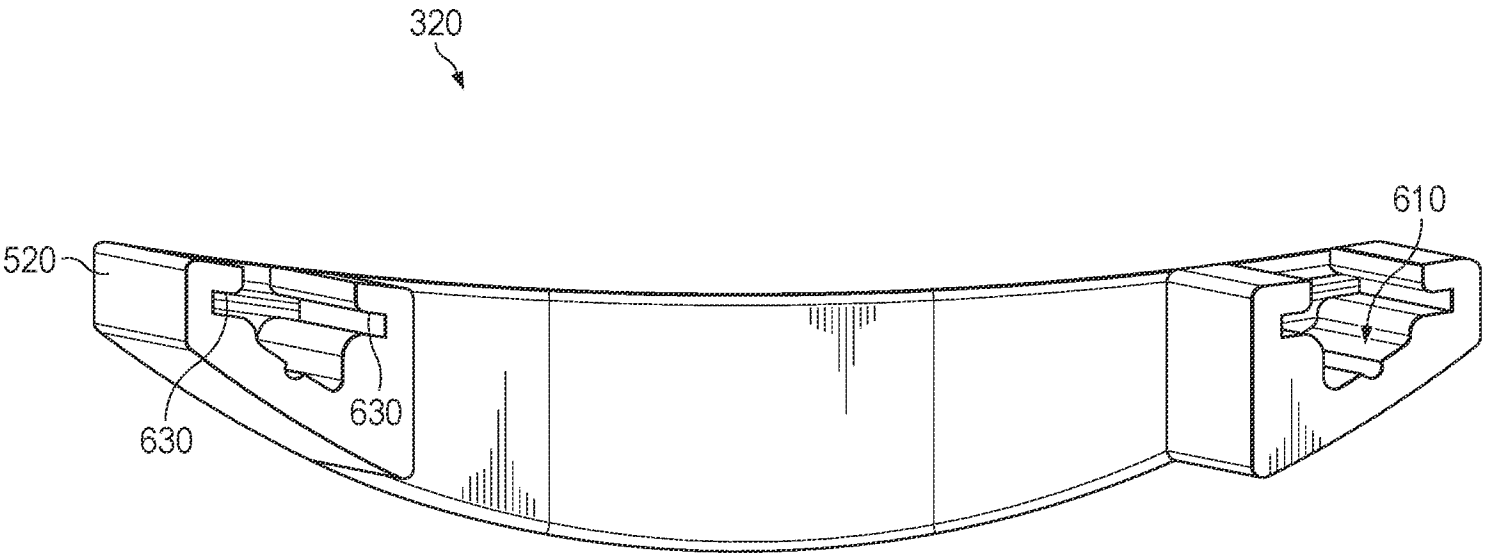
FIG. 6A shows a perspective view of a cross-section of an inflatable elastomeric ring of the disclosure corresponding to view 6A in FIG. 3.
Figure 6B:
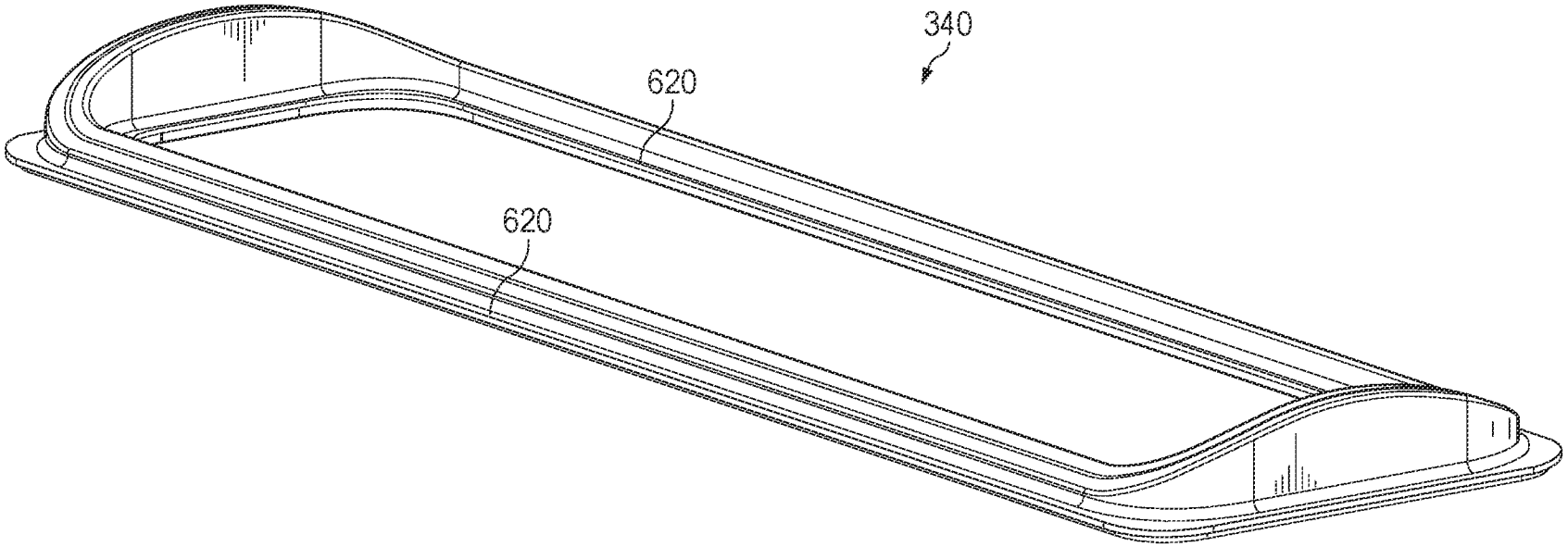
FIG. 6B shows a perspective view of a retaining insert of the formation probe sampling assembly of the disclosure, corresponding to view 6B in FIG. 3.
Figure 6C:
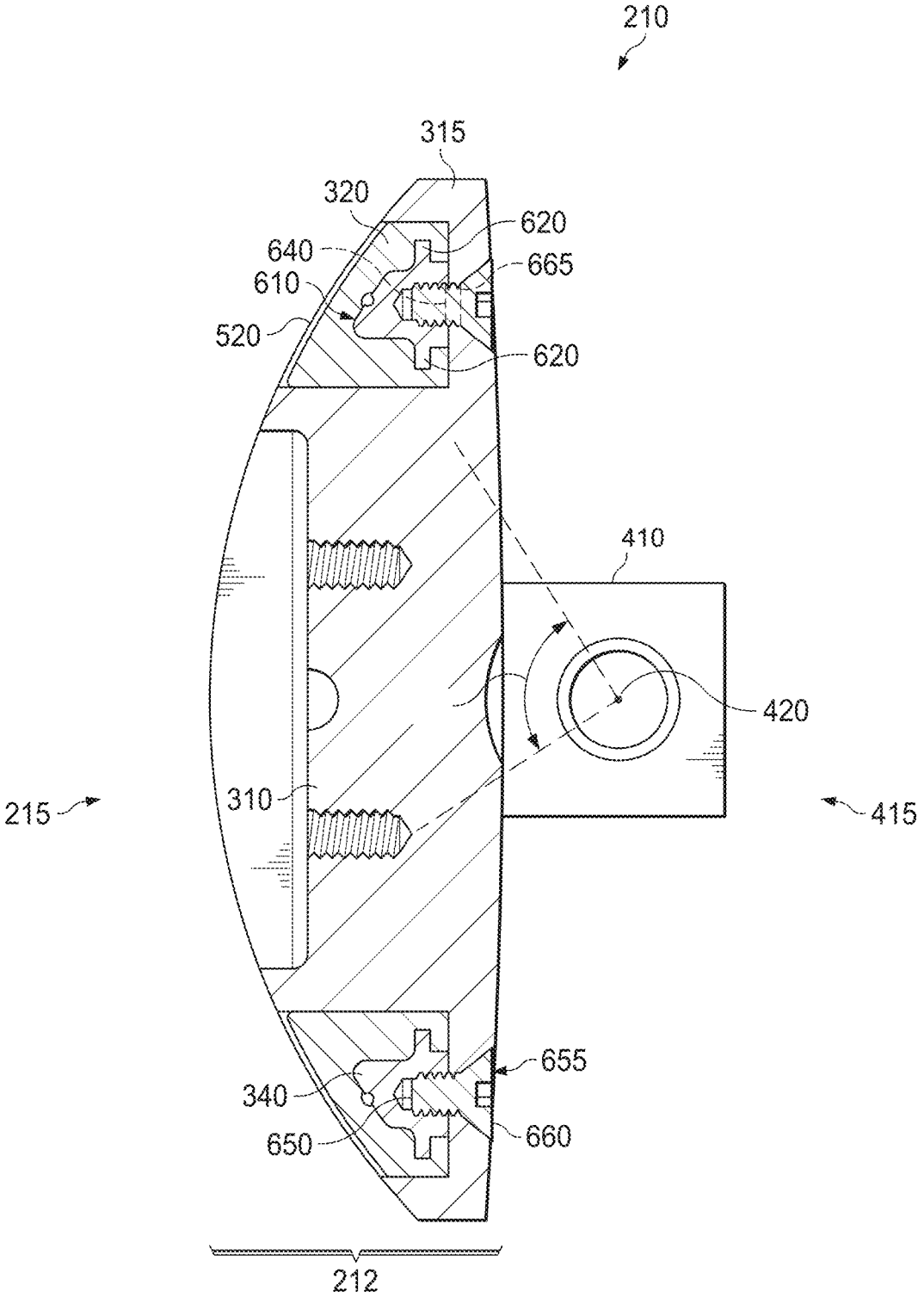
FIG. 6C shows a sectional view of the formation probe sampling assembly corresponding to view 6C in FIG. 3.

FIG. 6A shows a perspective view of a cross-section of the inflatable elastomeric ring 320 corresponding to view 6A in FIG. 3. FIG. 6B shows a perspective view of a retaining insert 340 of the assembly 210, corresponding to view 6B in FIG. 3. FIG. 6C shows a sectional view of the assembly 210 corresponding to view 6C in FIG. 3.

With continuing reference to FIGS. 6A-6C throughout, in some embodiments, the exterior bladder 520 includes one or more cavities 610 shaped to hold one or more rims 620 of a retaining insert 340 of the assembly 210, e.g., to facilitate keeping the ring on the metal plate when the ring is inflated. In some such embodiments, the one or more cavities each include one or more cavity slots 630 shaped to wrap around and hold one of the rims therein. In some such embodiments, the retaining insert 340 can include one or more openings 640 to hold an end 650 of a retaining pin 655 therein, and an opposite end 660 of the retaining pin (e.g., a screw, bolt or other retaining structures familiar to those skilled in the pertinent arts) situated though an opening 665 in the metal plate 310 to secure the retaining insert to the metal plate.

As noted above, some embodiments of the inflatable elastomeric ring are easily changeable. For instance, the inflatable elastomeric ring can be freely removed from the trough of the metal plate to facilitate replacement, e.g., without having to remove the plate from the assembly 210, and then remove the ring by cutting, routing, grinding or other procedures, that could destroy or damage the ring or the metal plate. This is in contrast to the use of solid rubber rings which, to help keep the ring in the trough, are often glued into a trough or formed in the trough by molding (e.g., flowing a pre-polymer resin into the trough followed by curing to form the solid rubbers ring). For instance, the retaining pin 655 can be removed from the retaining insert 340, the cavity slots 630 unwrapped from the rims 620 of the retaining insert 340, and the opening 425 of the inflatable elastomeric ring 320 uncoupleable from hydraulic fluid line 330, to thereby free the inflatable elastomeric ring from the seal pad, e.g., for inspection and reuse or replacement.

In other embodiments, however, the inflatable elastomeric ring can be bonded to the trough, e.g., by a rubber adhesive familiar to those skilled in the pertinent arts.

As illustrated in FIGS. 4 and 6C, some embodiments of the assembly 210 can further include a swivel pad 410 at a second end 415 of the assembly 210, the second end 415 on an opposite side of the assembly 210 as the first end 215. The assembly 210 is rotatable about one or more hinge points 420 of the swivel pad 410 to thereby change an orientation of the seal pad 212 relative to the formation wall 112.

For instance, cross sections of the boreholes 8, including the formation wall 112 targeted to be sampled from, are often oval-shaped instead of perfectly circular-shaped. By passively rotating about one or more hinge points 420 the seal pad 212 can be re-orientated such that the first end better conforms to the wall 112 to thereby obtain a tighter sealed space to the target portion of the wall 112. For instance, in some embodiments, the swivel pad can rotate about a hinge point 420 by an swivel angle 670 of at least about ±10, 20, 30 or 40 degrees As illustrated in FIGS. 2-4, embodiments of the test tool body 200 can further include one or more pistons 220 coupled to the metal plate 310. For instance, the pistons 220 can be hydraulically driven, e.g., by hydraulic fluid fed through a hydraulic line 430 connected to a piston chamber 432 holding the pistons 220, to extend the seal pad 212 of the assembly 210 out of the opening 218 to contact the formation wall 112. In other embodiments, however, the pistons could be actuated by an electrically powered motor (e.g., powered by power source 113*c*).

Then, the inflatable elastomeric ring can be inflated, e.g. in some embodiments, by the hydraulic fluid being fed through a separately controlled second hydraulic line 330 connected to the opening 425 in the exterior bladder 520.

After sampling, the inflatable elastomeric ring can be deflated by withdrawing the hydraulic fluid through the second hydraulic line 330 and then the seal pad can be retracted into the opening of the outer surface of the tester tool body by withdrawing the hydraulic fluid through the first hydraulic line 430 to cause the one or more pistons 220 to retract.

In some embodiments, the tester tool body 200 can further include a mechanical assembly 440 connected to move the assembly 210 in a lateral direction 445 parallel to the outer surface 205 of the test tool body 200 and parallel to the wall 112 of the borehole 8 when placed in the borehole. In some such embodiments, the mechanical assembly can be actuated by the hydraulic fluid flowed into or out of a third hydraulic line 450 such that a gear structure of the assembly moves the assembly 210 along the lateral direction 445. In other embodiments, however, the mechanical assembly can be actuated by an electrically powered motor (e.g., powered by power source 113*c*).

As illustrated in FIGS. 2, 3 and 5A, any embodiments of the assembly 210 further include one or more sampling ports 230 located in a portion of the metal plate surrounded by the inflatable elastomeric ring 320, e.g., so as to collect formation fluid entering the seal space 217 when the seal pad is extended to contact the formation wall and the hollow interior of the ring is inflated. Formation fluid entering the one or more sampling ports 230 can be transfer by one or more sampling lines 235 to other components of the apparatus 10 for analysis (e.g., downhole sensor 113*b*).

Any of the embodiments of the apparatus 10 can be part of a drilling operations system 100, the system including a drilling rig 102 located at a surface 104 of the well and providing support for a drill string 105 wherein the apparatus is mounted to the drill string or a wireline tool Another embodiment of the disclosure is a method that includes assembling a formation sampling probe of the disclosure. FIG. 7 presents a flow diagram of an example method 700 of assembling a formation sampling probe in accordance with the present disclosure.

As illustrated, and with continuing references to FIGS. 1-7 throughout, the method 700 includes a step 710 of assembling a formation sampling probe assembly 210 for subterranean formation testing within a borehole 8 of a well.

Assembling (step 710) includes a step 720 of forming a seal pad 212 of the assembly 210. Forming the seal pad (step 720) includes: a step 730 of placing an inflatable elastomeric ring 320 into a trough 315 of a metal plate 310, the trough defining a closed track in the metal plate, a step 740 of coupling an opening 425 in an exterior bladder 520 of the inflatable elastomeric ring to a hydraulic fluid line 330, and a step 750 of connecting the inflatable elastomeric ring to a retaining insert 340 by wrapping a cavity 610 of the exterior bladder around a rim 620 of the retaining insert.

Assembling (step 710) also includes a step 760 of coupling the seal pad to a test tool body 200 of the assembly 210 the tool body having an outer surface 205. The metal plate is connected to internal tool body extendible pistons 220 of the assembly 210 to thereby make the seal pad operably extendable out of, and retractable into, an opening 218 in the outer surface of the body.

Another embodiment is a method of obtaining a formation sample using a formation sampling probe of the disclosure. FIG. 8 presents a flow diagram of an example method 800 of obtaining a formation sample in accordance with the present disclosure.

As illustrated, and with continuing references to FIGS. 1-8 throughout, the method 800 includes a step 810 of obtaining a formation sample using a formation probe sampling assembly 210 deployed within a borehole 8 of a well site of a subterranean formation. Obtaining the sample (step 810) includes a step 820 of situating a downhole testing tool 110 adjacent a formation wall 112 of the borehole, wherein the down hole testing tool includes a downhole sampling device 113*a*.

As disclosed herein the downhole sampling device include a test tool body 200 having an outer surface 205, and, the assembly 210 extendable out of and retractable into an opening 218 in the outer surface. The assembly 210 includes a seal pad 212 at a first end 215 of the assembly 210, and the seal pad includes at the first end a metal plate 310 with a trough 315 therein, the trough defining a closed track in the metal plate, the trough having dimensions to hold a portion of an inflatable elastomeric ring 320 shaped to fit in the trough.

Obtaining the sample (step 810) includes a step 830 of operating the seal pad to contact the formation wall by extending the seal pad through the opening past the outer surface to thereby define a seal space 217 between the borehole and the seal pad, a step 840 inflating the inflatable elastomeric ring to create a fluid seal in the seal space 217 between the formation wall and the seal pad, a step 850 of collecting the formation sample corresponding to formation fluid flowing from the formation wall into the seal space, and a step 860 of transferring the formation sample by a sample transfer line 235 to another device of the downhole testing tool.

Each of the foregoing embodiments may include one or more of the following elements singly or in combination, and neither the example embodiments or the following listed elements limit the disclosure, but are provided as examples of the various embodiments covered by the disclosure:

Element 1: a formation testing apparatus, comprising: a downhole testing tool for subterranean formation testing within a borehole of a well, the downhole testing tool including a downhole sampling device having: a test tool body having an outer surface; and a formation probe sampling assembly extendable out of and retractable into an opening in the outer surface, wherein: the formation probe sampling assembly includes a seal pad at a first end of the formation probe sampling assembly, the seal pad operable to contact a formation wall of the borehole when the seal pad is extended past the outer surface to thereby define a seal space between the borehole and the seal pad, and the seal pad includes at the first end includes a metal plate with a trough therein, the trough defining a closed track in the metal plate, the trough having dimensions to hold a portion of an inflatable elastomeric ring shaped to fit in the trough Element 2: the apparatus further including the inflatable elastomeric ring, wherein inflation of the inflatable elastomeric ring creates a fluid seal in the seal space between the formation wall and the seal pad.

Element 3: the apparatus wherein the inflatable elastomeric ring includes a hollow interior and an exterior bladder, the exterior bladder including an opening coupleable to a hydraulic fluid line of the downhole testing tool.

Element 4: the apparatus wherein a total external volume of the inflatable elastomeric ring is expandable by at least 10% when a hydraulic fluid is flowed into the hollow interior to a pressure of about 50 psi, respectively, as compared to a total external deflated volume of the inflatable elastomeric ring the hollow interior is at ambient pressure.

Element 5: the apparatus wherein the exterior bladder is composed of silicon rubber, a fluoroelastomeric rubber, or a copolymer rubber.

Element 6: the apparatus wherein the exterior bladder includes one or more cavities shaped to hold one or more rims of a retaining insert of the formation probe sampling assembly.

Element 7: the apparatus wherein the one or more cavities each include one or more cavity slots shaped to wrap around and hold one of the rims therein.

Element 8: the apparatus wherein the retaining insert includes one or more openings to hold an end of a retaining pin therein, and an opposite end of the retaining pin situated though an opening in the metal plate to secure the retaining insert to the metal plate.

Element 9: the apparatus wherein the inflatable elastomeric ring is freely removable from the trough.

Element 10: the apparatus wherein the inflatable elastomeric ring is bonded to the trough.

Element 11: the apparatus wherein the formation probe sampling assembly includes a swivel pad at a second end of the formation probe sampling assembly, the second end on an opposite side of the formation probe sampling assembly as the first end, and the formation probe sampling assembly is rotatable about one or more hinge points of the swivel pad to thereby change an orientation of the seal pad relative to the formation wall.

Element 12: the apparatus wherein the swivel pad can rotate about the hinge point by an swivel angle of at least ±10 degrees.

Element 13: the apparatus wherein the test tool body further includes one or more pistons coupled to the metal plate.

Element 14: the apparatus wherein the one or more pistons are hydraulic fluid-driven by flowing hydraulic fluid through a hydraulic line connected to a piston chamber holding the pistons.

Element 15: the apparatus wherein the tester tool body further includes a mechanical assembly connected to move the formation probe sampling assembly in a lateral direction parallel to the outer surface of the test tool body.

Element 16: the apparatus wherein the mechanical assembly is hydraulic fluid-driven by hydraulic fluid flowed through a third hydraulic line such that a gear structure of the assembly moves the formation probe sampling assembly along the lateral direction.

Element 17: the apparatus further including one or more sampling ports located in a portion of the metal plate surrounded by the inflatable elastomeric ring and connected to one or more sample lines.

Element 18: wherein the apparatus is part of a drilling operations system, the system including a drilling rig located at a surface of the well and providing support for a drill string wherein the apparatus is mounted to the drill string or a wireline tool.

Element 19: a method, comprising: assembling a formation sampling probe for subterranean formation testing within a borehole of a well site including: forming a seal pad of the formation probe sampling assembly, including placing an inflatable elastomeric ring into a trough of a metal plate, the trough defining a closed track in the metal plate, coupling an opening in an exterior bladder of the inflatable elastomeric ring to a hydraulic fluid line, and connecting the inflatable elastomeric ring to a retaining insert by wrapping a cavity of the exterior bladder around a rim of the retaining insert; and coupling the seal pad to a test tool body of the formation probe sampling assembly the tool body having an outer surface, wherein the metal plate is connected to internal tool body extendible pistons of the formation probe sampling assembly to there make the seal pad operably extendable out of, and retractable into, an opening in the outer surface of the body.

Element 20: A method, comprising: obtaining a formation sample using a formation probe sampling assembly deployed within a borehole of a well site of a subterranean formation, including: situating a downhole testing tool adjacent a formation wall of the borehole, wherein the down hole testing tool downhole testing tool includes a downhole sampling device including:

a test tool body having an outer surface; and the formation probe sampling assembly extendable out of and retractable into an opening in the outer surface, wherein: the formation probe sampling assembly includes a seal pad at a first end of the formation probe sampling assembly, and the seal pad includes at the first end a metal plate with a trough therein, the trough defining a closed track in the metal plate, the trough having dimensions to hold a portion of an inflatable elastomeric ring shaped to fit in the trough; operating the seal pad to contact the formation wall by extending the seal pad through the opening past the outer surface to thereby define a seal space between the borehole and the seal pad; inflating the inflatable elastomeric ring to create a fluid seal in the seal space between the formation wall and the seal pad; collecting the formation sample corresponding to formation fluid flowing from the formation wall into the seal space; and transferring the formation sample by a sample transfer line to another device of the downhole testing tool.

The foregoing listed embodiments and elements do not limit the disclosure to just those listed above, and those skilled in the art to which this application relates will appreciate that other and further additions, deletions, substitutions and modifications may be made to the described embodiments.

What is claimed is:

1. A formation testing apparatus, comprising:

a downhole testing tool for subterranean formation testing within a borehole of a well, the downhole testing tool including a downhole sampling device having:

a test tool body having an outer surface; and a formation probe sampling assembly extendable out of and retractable into an opening in the outer surface, wherein:

the formation probe sampling assembly includes a seal pad at a first end of the formation probe sampling assembly, the seal pad operable to contact a formation wall of the borehole when the seal pad is extended past the outer surface to thereby define a seal space between the borehole and the seal pad, the seal pad includes at the first end includes a metal plate with a trough therein, the trough defining a closed track in the metal plate, the trough having dimensions to hold a portion of an inflatable elastomeric ring shaped to fit in the trough; and further including the inflatable elastomeric ring, wherein inflation of the inflatable elastomeric ring creates a fluid seal in the seal space between the formation wall and the seal pad, the inflatable elastomeric ring includes a hollow interior and an exterior bladder, the exterior bladder including an opening coupleable to a hydraulic fluid line of the downhole testing tool and the exterior bladder includes one or more cavities shaped to hold one or more rims of a retaining insert of the formation probe sampling assembly.

2. The apparatus of claim 1, wherein the one or more cavities each include one or more cavity slots shaped to wrap around and hold one of the rims therein.

3. The apparatus of claim 2, wherein the retaining insert includes one or more openings to hold an end of a retaining pin therein, and an opposite end of the retaining pin situated though an opening in the metal plate to secure the retaining insert to the metal plate.

4. The apparatus of claim 1, wherein the apparatus is part of a drilling operations system, the system including a drilling rig located at a surface of the well and providing support for a drill string wherein the apparatus is mounted to the drill string or a wireline tool.

5. A formation testing apparatus, comprising:

a downhole testing tool for subterranean formation testing within a borehole of a well, the downhole testing tool including a downhole sampling device having:

a test tool body having an outer surface; and a formation probe sampling assembly extendable out of and retractable into an opening in the outer surface, wherein:

the formation probe sampling assembly includes a seal pad at a first end of the formation probe sampling assembly, the seal pad operable to contact a formation wall of the borehole when the seal pad is extended past the outer surface to thereby define a seal space between the borehole and the seal pad, the seal pad includes at the first end includes a metal plate with a trough therein, the trough defining a closed track in the metal plate, the trough having dimensions to hold a portion of an inflatable elastomeric ring shaped to fit in the trough, and wherein the tester tool body further includes a mechanical assembly connected to move the formation probe sampling assembly in a lateral direction parallel to the outer surface of the test tool body.

6. The apparatus of claim 5, further including the inflatable elastomeric ring, wherein inflation of the inflatable elastomeric ring creates a fluid seal in the seal space between the formation wall and the seal pad.

7. The apparatus of claim 6, wherein the inflatable elastomeric ring includes a hollow interior and an exterior bladder, the exterior bladder including an opening coupleable to a hydraulic fluid line of the downhole testing tool.

8. The apparatus of claim 6, wherein a total external volume of the inflatable elastomeric ring is expandable by at least 10% when a hydraulic fluid is flowed into the hollow interior to a pressure of about 50 psi, respectively, as compared to a total external deflated volume of the inflatable elastomeric ring the hollow interior is at ambient pressure.

9. The apparatus of claim 6, wherein the exterior bladder is composed of silicon rubber, a fluoroelastomeric rubber, or a copolymer rubber.

10. The apparatus of claim 5, wherein the inflatable elastomeric ring is freely removable from the trough.

11. The apparatus of claim 5, wherein the inflatable elastomeric ring is bonded to the trough.

12. The apparatus of claim 5, wherein the formation probe sampling assembly includes a swivel pad at a second end of the formation probe sampling assembly, the second end on an opposite side of the formation probe sampling assembly as the first end, and the formation probe sampling assembly is rotatable about one or more hinge points of the swivel pad to thereby change an orientation of the seal pad relative to the formation wall.

13. The apparatus of claim 12, wherein the swivel pad can rotate about the one or more hinge points by an swivel angle of at least ±10 degrees.

14. The apparatus of claim 5, wherein the test tool body further includes one or more pistons coupled to the metal plate.

15. The apparatus of claim 14, wherein the one or more pistons are hydraulic fluid-driven by flowing hydraulic fluid through a hydraulic line connected to a piston chamber holding the pistons.

16. The apparatus of claim 5, wherein the mechanical assembly is hydraulic fluid-driven by hydraulic fluid flowed through a third hydraulic line such that a gear structure of the assembly moves the formation probe sampling assembly along the lateral direction.

17. The apparatus of claim 5, further including one or more sampling ports located in a portion of the metal plate surrounded by the inflatable elastomeric ring and connected to one or more sample lines.

18. The apparatus of claim 5, wherein the apparatus is part of a drilling operations system, the system including a drilling rig located at a surface of the well and providing support for a drill string wherein the apparatus is mounted to the drill string or a wireline tool.

19. A method, comprising:

assembling a formation sampling probe for subterranean formation testing within a borehole of a well site including:

forming a seal pad of the formation probe sampling assembly, including placing an inflatable elastomeric ring into a trough of a metal plate, the trough defining a closed track in the metal plate, coupling an opening in an exterior bladder of the inflatable elastomeric ring to a hydraulic fluid line, and connecting the inflatable elastomeric ring to a retaining insert by wrapping a cavity of the exterior bladder around a rim of the retaining insert, wherein the exterior bladder includes one or more cavities shaped to hold one or more of the rims of the retaining insert of the formation probe sampling assembly; and coupling the seal pad to a test tool body of the formation probe sampling assembly the tool body having an outer surface, wherein the metal plate is connected to internal tool body extendible pistons of the formation probe sampling assembly to thereby make the seal pad operably extendable out of, and retractable into, an opening in the outer surface of the body.

20. A method, comprising:

obtaining a formation sample using a formation probe sampling assembly deployed within a borehole of a well site of a subterranean formation, including:

situating a downhole testing tool adjacent a formation wall of the borehole, wherein the down hole testing tool downhole testing tool includes a downhole sampling device including:

a test tool body having an outer surface; and the formation probe sampling assembly extendable out of and retractable into an opening in the outer surface, wherein:

the formation probe sampling assembly includes a seal pad at a first end of the formation probe sampling assembly, and the seal pad includes at the first end a metal plate with a trough therein, the trough defining a closed track in the metal plate, the trough having dimensions to hold a portion of an inflatable elastomeric ring shaped to fit in the trough;

operating the seal pad to contact the formation wall by extending the seal pad through the opening past the outer surface to thereby define a seal space between the borehole and the seal pad;

inflating the inflatable elastomeric ring with a hydraulic fluid to create a fluid seal in the seal space between the formation wall and the seal pad, wherein the inflatable elastomeric ring includes a hollow interior and an exterior bladder, the exterior bladder including one or more cavities shaped to hold one or more rims of the retaining insert of the formation probe sampling assembly and an opening coupleable to a hydraulic fluid line of the downhole testing tool;

collecting the formation sample corresponding to formation fluid flowing from the formation wall into the seal space; and transferring the formation sample by a sample transfer line to another device of the downhole testing tool.

* * * * *